US010081181B2

(12) United States Patent
Tomimatsu et al.

(10) Patent No.: US 10,081,181 B2
(45) Date of Patent: Sep. 25, 2018

(54) LIQUID EJECTING HEAD AND LIQUID EJECTING APPARATUS

(71) Applicant: SEIKO EPSON CORPORATION, Tokyo (JP)

(72) Inventors: Shingo Tomimatsu, Matsumoto (JP); Yoichi Naganuma, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/631,696

(22) Filed: Jun. 23, 2017

(65) Prior Publication Data

US 2018/0001635 A1 Jan. 4, 2018

(30) Foreign Application Priority Data

Jun. 29, 2016 (JP) ..... 2016-128514

(51) Int. Cl.
*B41J 2/14* (2006.01)

(52) U.S. Cl.
CPC ..... *B41J 2/14233* (2013.01); *B41J 2/1433* (2013.01); *B41J 2002/14241* (2013.01); *B41J 2002/14306* (2013.01); *B41J 2202/11* (2013.01)

(58) Field of Classification Search
CPC ..... B41J 2/14233; B41J 2/1433; B41J 2002/14241; B41J 2002/14306; B41J 2202/11
See application file for complete search history.

(56) References Cited

U.S. PATENT DOCUMENTS 4,882,595 A 11/1989 Trueba et al.
2009/0225138 A1 9/2009 Watanabe
2016/0059552 A1* 3/2016 Takabe ..... B41J 2/161 347/65

FOREIGN PATENT DOCUMENTS

JP 01-152068 A 6/1989
JP 08-224872 A 9/1996
(Continued)

*Primary Examiner* — Geoffrey Mruk
(74) *Attorney, Agent, or Firm* — Workman Nydegger

(57) ABSTRACT

A liquid ejecting head includes a pressure chamber formation substrate provided with pressure chambers that are disposed side by side and that communicate with nozzles that discharge a liquid, a nozzle plate provided with the nozzles, and a flow path formation substrate provided between the pressure chamber formation substrate and the nozzle plate. The flow path formation substrate has a plurality of individual communication paths that supply the liquid to the pressure chambers disposed side by side, a common liquid chamber that communicates with the pressure chambers, a liquid introduction port that introduces the liquid into the common liquid chamber, and a flow path of the liquid from the liquid introduction port toward the individual communication paths. The flow path formation substrate has a thick wall portion and a thin wall portion that are located at a pressure chamber formation substrate side of the common liquid chamber and that have a relatively large substrate thickness and a relatively small substrate thickness, respectively. The thick wall portion causes area of a cross-section of the flow path taken along a thickness direction of the flow path formation substrate to be smaller at an individual communication path side than at a liquid introduction port side. The thick wall portion includes a first inclined portion that, in a plan view from the nozzle plate side, is inclined from the liquid introduction port side toward at least one end side of two end sides of the plurality of individual communication paths in a side-by-side direction in which the pressure chambers are provided side by side and along which the individual communication paths are provided.

10 Claims, 9 Drawing Sheets

(56) References Cited

FOREIGN PATENT DOCUMENTS

| | | | |
|---|---|---|---|
| JP | 2006-205621 | A | 8/2006 |
| JP | 2014-088034 | A | 5/2014 |
| JP | 2016-049726 | A | 4/2016 |

* cited by examiner

LIQUID EJECTING HEAD AND LIQUID EJECTING APPARATUS

BACKGROUND

1. Technical Field

The entire disclosure of Japanese Patent Application No: 2016-128514, filed Jun. 29, 2016 is expressly incorporated by reference herein in its entirety.

The present invention relates to a liquid ejecting head and a liquid ejecting apparatus.

2. Related Art

Liquid ejecting heads that eject liquid in the form of droplets have been known as, for example, ink jet type recording heads. A liquid ejecting head includes, for example, nozzle holes formed in a nozzle plate and pressure chambers that communicate with the nozzle holes, and ejects a liquid in the form of droplets from nozzle holes by causing pressure changes in the liquid in the pressure chamber through the use of pressure generators. In such a liquid ejecting head, a flow path formation substrate is provided between the nozzle plate and a pressure chamber formation substrate that is provided with a plurality of pressure chambers disposed side by side. The flow path formation substrate is provided with a common liquid chamber that communicates with the plurality of pressure chambers, a liquid introduction port that introduces liquid into the common liquid chamber, and individual communication paths that individually provide communication between the individual pressure chambers and the common liquid chamber.

For example, a liquid discharge head (liquid ejecting head) disclosed in JP-A-2016-49726 includes a flow path cavity (common liquid chamber) formed in a communication substrate (flow path formation substrate) by forming a dent in the opposite surface of the communication substrate to pressure chambers and an inclined surface that is inclined in such a direction that a ceiling portion of the flow path cavity becomes lower in a direction from the ceiling portion to individual communication openings (individual communication paths).

However, in JP-A-2016-49726, in a plan view from the nozzle plate side, a boundary portion (inclined surface) defined by a thin wall portion (ceiling portion) and a thick wall portion of the flow path formation substrate extends along a lengthwise direction of the common liquid chamber (direction in which pressure chambers are disposed side by side). In a middle portion of the common liquid chamber in the side-by-side direction, the liquid moving from an introduction port toward individual communication paths flows substantially orthogonally to the side-by-side direction, so that there is a risk that gas bubbles mixed in the liquid may reside on a middle portion of the boundary portion Such gas bubbles incur a risk that the amounts of the liquid supplied from the individual communication paths to the pressure chambers may vary, adversely affecting the liquid discharging performance.

SUMMARY

An advantage of some aspects of the invention is that a liquid ejecting head and a liquid ejecting apparatus that achieves improved liquid discharging performance are provided.

A liquid ejecting head according to an aspect of the invention includes a pressure chamber formation substrate provided with pressure chambers that are disposed side by side and that communicate with nozzles that discharge a liquid, a nozzle plate provided with the nozzles, and a flow path formation substrate provided between the pressure chamber formation substrate and the nozzle plate. The flow path formation substrate has a plurality of individual communication paths that supply the liquid to the pressure chambers disposed side by side, a common liquid chamber that communicates with the pressure chambers, a liquid introduction port that introduces the liquid into the common liquid chamber, and a flow path of the liquid from the liquid introduction port toward the individual communication paths. The flow path formation substrate has a thick wall portion and a thin wall portion that are located at a pressure chamber formation substrate side of the common liquid chamber and that have a relatively large substrate thickness and a relatively small substrate thickness, respectively. The thick wall portion causes area of a cross-section of the flow path taken along a thickness direction of the flow path formation substrate to be smaller at an individual communication path side than at a liquid introduction port side. The thick wall portion includes a first inclined portion that, in a plan view from the nozzle plate side, is inclined from the liquid introduction port side toward at least one end side of two end sides of the plurality of individual communication paths in a side-by-side direction in which the pressure chambers are provided side by side and along which the individual communication paths are provided.

According to this aspect, the flow path formation substrate of the liquid ejecting head has the thick wall portion and the thin wall portion that are located at the pressure chamber formation substrate side of the common liquid chamber and that are relatively thick and thin in substrate thickness. Furthermore, the area of a cross-section of the flow path taken in the thickness direction of the flow path formation substrate is smaller at the individual communication path side than at the liquid introduction port side because of the thick wall portion. That is, the thick wall portion is provided at the individual communication path side of the flow path of the liquid, that is, the downstream side thereof. Furthermore, the thick wall portion has the first inclined portion that, in a plan view from the nozzle plate side, is inclined from the liquid introduction port side toward at least one of the two end sides of the plurality of individual communication paths in the side-by-side direction in which the pressure chambers are disposed side by side.

The liquid flows from the liquid introduction port toward the individual communication paths and then are supplied into the pressure chambers. Gas bubbles contained in the liquid rise by buoyancy to an upper portion (a pressure chamber side) of the common liquid chamber and, on the thin wall portion, move together with the liquid toward the individual communication paths. When the gas bubbles reach the thick wall portion, the gas bubbles then move along the first inclined portion formed on the thick wall portion to the at least one end side of the individual communication paths in the side-by-side direction. This prevents gas bubbles from residing on the boundary portion between the thick wall portion and the thin wall portion, so that the amounts of liquid supplied from the individual communication paths into the pressure chambers are stable. Therefore, a liquid ejecting head that achieves improved liquid discharging performance can be provided.

In the foregoing liquid ejecting head, at least one individual communication path located at the at least one end side may be formed in the thin wall portion and the individual communication paths other than the at least one individual communication path located at the at least one end side may be formed in the thick wall portion.

In this liquid ejecting head, since the at least one individual communication path located at an end side are formed in the thin wall portion, the gas bubbles moving along the first inclined portion to the end side can be emitted out through the end-side at least one individual communication path. This improves the gas bubble emitting capability of emitting gas bubbles.

The foregoing liquid ejecting head according to the aspect of the invention may further include a plurality of the liquid introduction port and a second inclined portion that, in a plan view from the nozzle plate side, is protruded from between the plurality of liquid introduction ports toward the first inclined portion.

Since this liquid ejecting head includes the second inclined portion protruded from between the plurality of liquid introduction ports toward the first inclined portion, the liquid ejecting head can reduce disturbance of liquid flow caused by interference from the liquid introduced from the liquid introduction ports.

In the foregoing liquid ejecting head according to the aspect of the invention, a length of the first inclined portion along the side-by-side direction may be greater than a length of the second inclined portion along the side-by-side direction.

According to this liquid ejecting head, since the length of the first inclined portion along the side-by-side direction is greater than the length of the second inclined portion along the side-by-side direction, the gas bubbles contained in the liquid introduced from the liquid introduction ports more readily move to the end sides of the individual communication paths in the side-by-side direction.

The foregoing liquid ejecting head according to the aspect of the invention may further include a plurality of the liquid introduction port, and a first center line that is along a direction intersecting the side-by-side direction and that divides a line segment connecting the individual communication paths at two ends in the side-by-side direction into two equal parts and a second center line that is along a direction intersecting the side-by-side direction and that divides a space interval between the liquid introduction ports into two equal parts may be at different locations, and the first inclined portion may be asymmetric with respect to the second center line.

According to this liquid ejecting head, even in the case where liquid is introduced from the liquid introduction ports in different flow amounts at different flow speeds in relation to the size, location, etc. of the plurality of liquid introduction ports provided for the common liquid chamber, for example, in the side-by-side direction, setting the first center line and the second center line at different locations and making the first inclined portion asymmetric with respect to the second center line will make it possible to rectify the flow of the liquid flowing from the liquid introduction ports to the individual communication paths and therefore suitably cause the gas bubbles contained in the liquid to move to the two opposite ends of the individual communication paths in the side-by-side direction.

A liquid ejecting apparatus according to another aspect of the invention includes any one of the above-described liquid ejecting heads.

According to this aspect of the invention, since the liquid ejecting apparatus include one of the liquid ejecting heads described above, the liquid ejecting apparatus achieves improved ink discharging performance.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
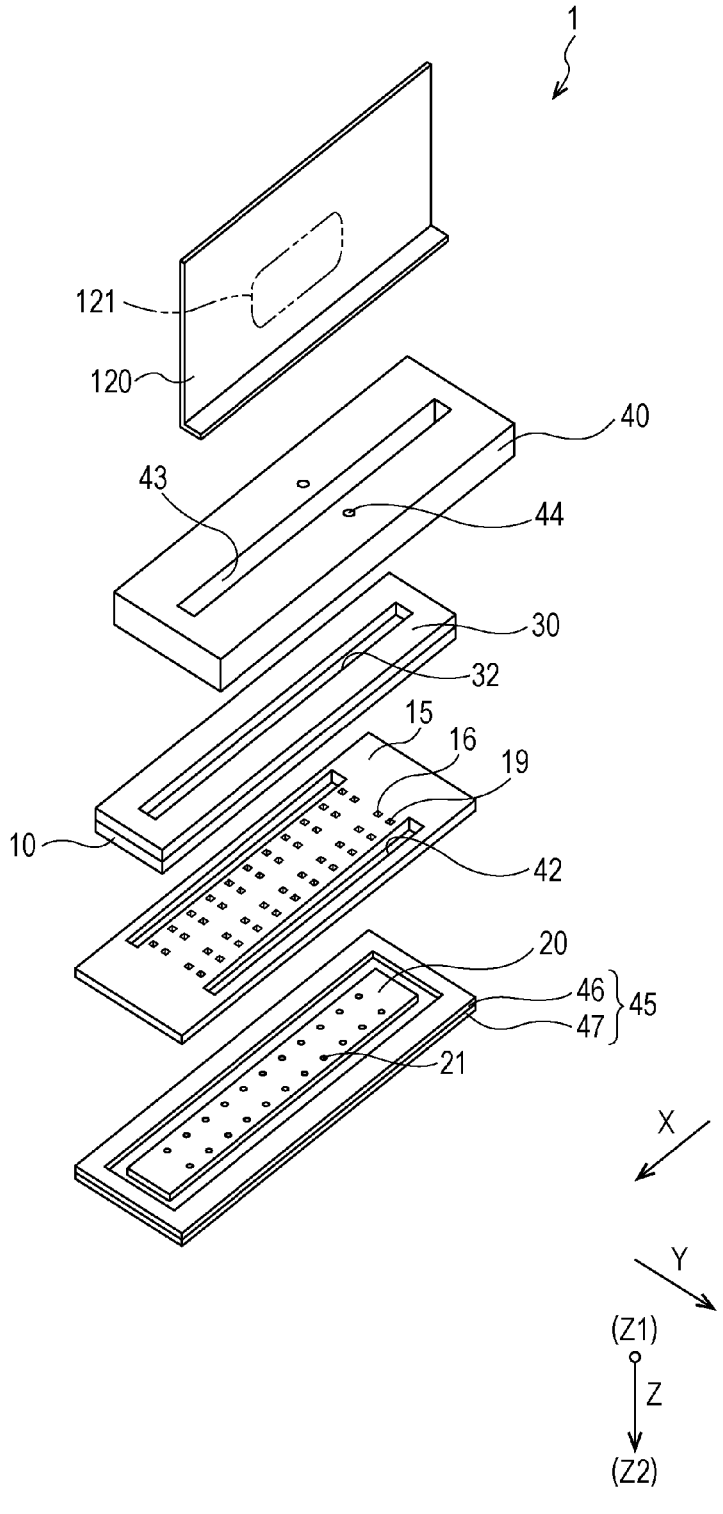
FIG. 1 is an exploded perspective view of a liquid ejecting head according to Exemplary Embodiment 1.

Exemplary embodiments of the invention will be described hereinafter with reference to the drawings. In the drawings referred to below, the size proportions of various layers, various members, etc. depicted are different from the actual ones so as to have recognizable sizes.

Furthermore, for convenience in illustration, FIGS. 1 to 10 show each two or three axes of an X-axis, a Y-axis, and a Z-axis that are three mutually orthogonal axes. A distal end side of each of arrows indicating axis directions is referred to as "positive side" and the proximal end side thereof is referred to as "negative side". The directions parallel to the X-axis are referred to as "X-axis directions", the directions parallel to the Y-axis are referred to as "Y-axis directions", and the directions parallel to the Z-axis are referred to as "Z-axis directions".

Exemplary Embodiment 1

Figure 2:
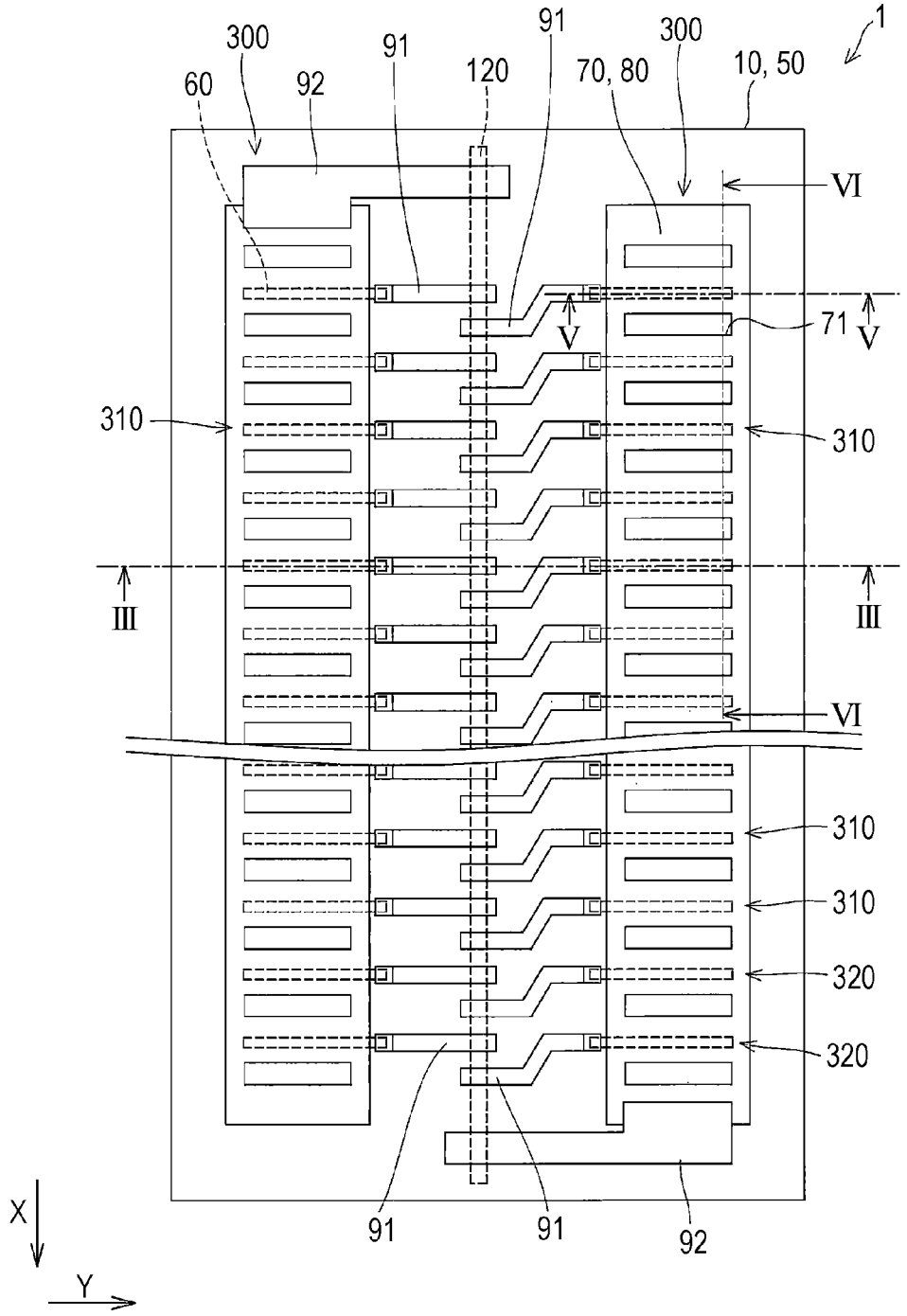
FIG. 2 is a plan view of portions of a pressure chamber formation substrate of the liquid ejecting head.
Figure 3:
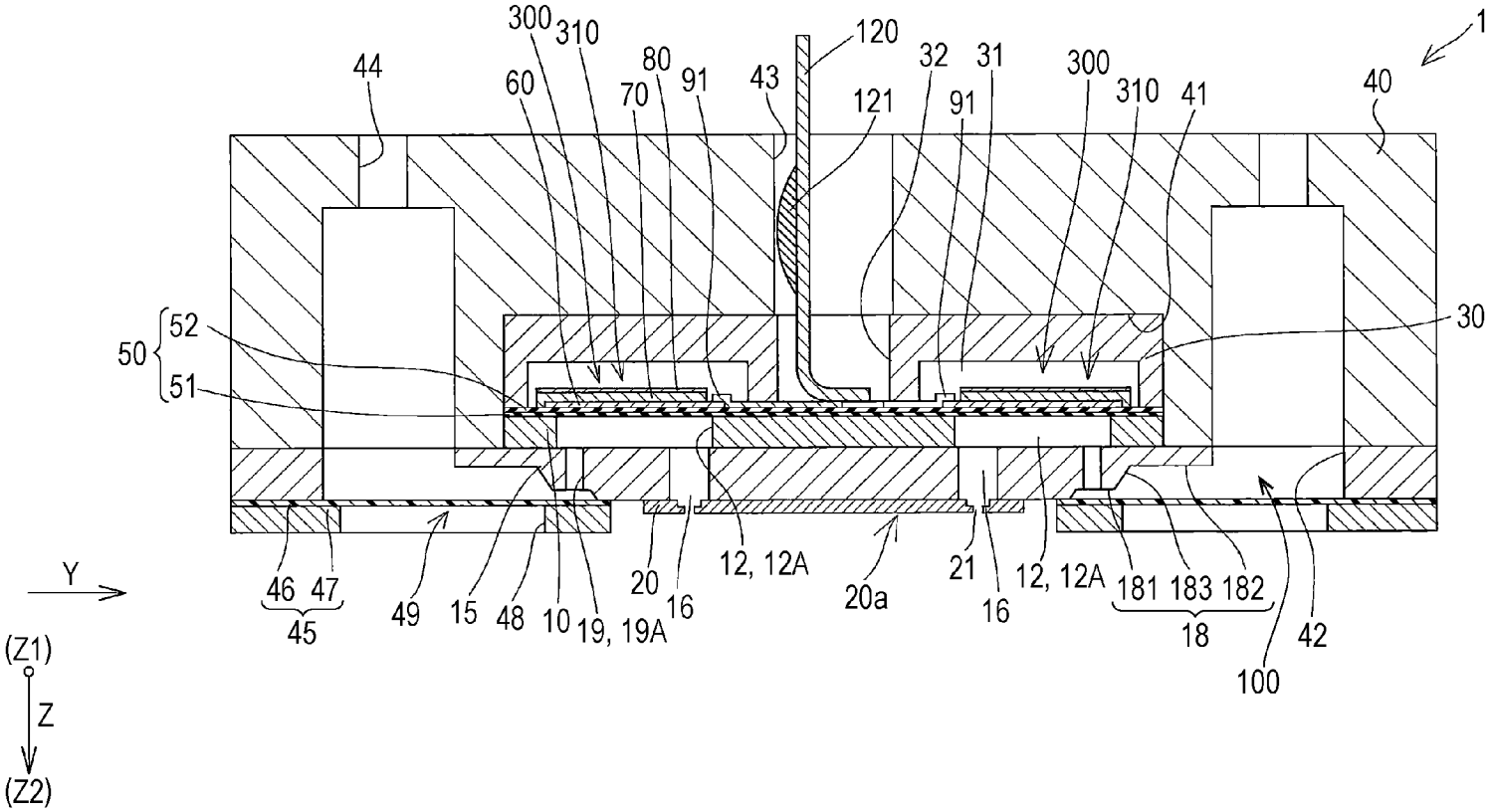
FIG. 3 is a sectional view taken on line III-III in FIG. 2.
Figure 4:
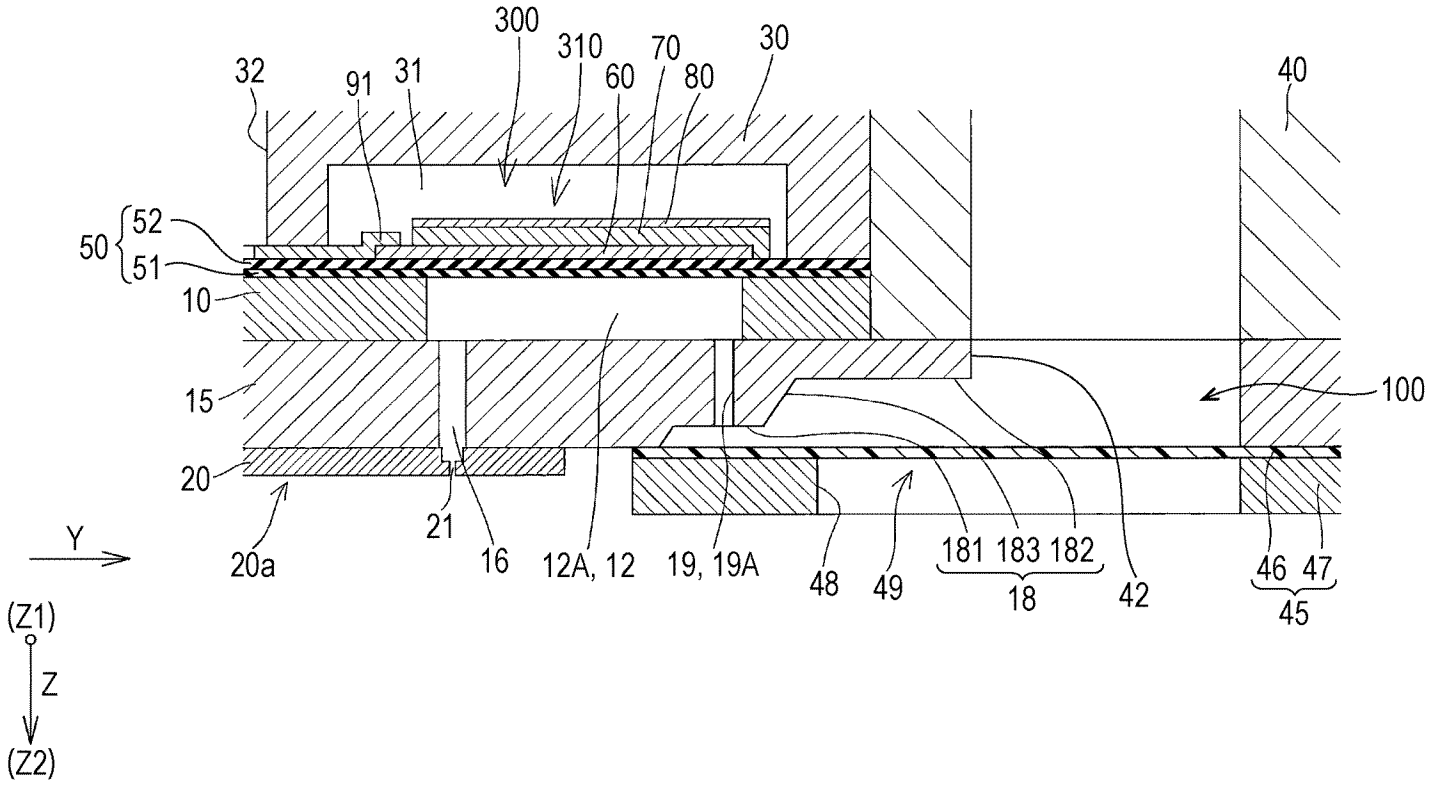
FIG. 4 is an enlarged view of portions shown in FIG. 3.
Figure 5:
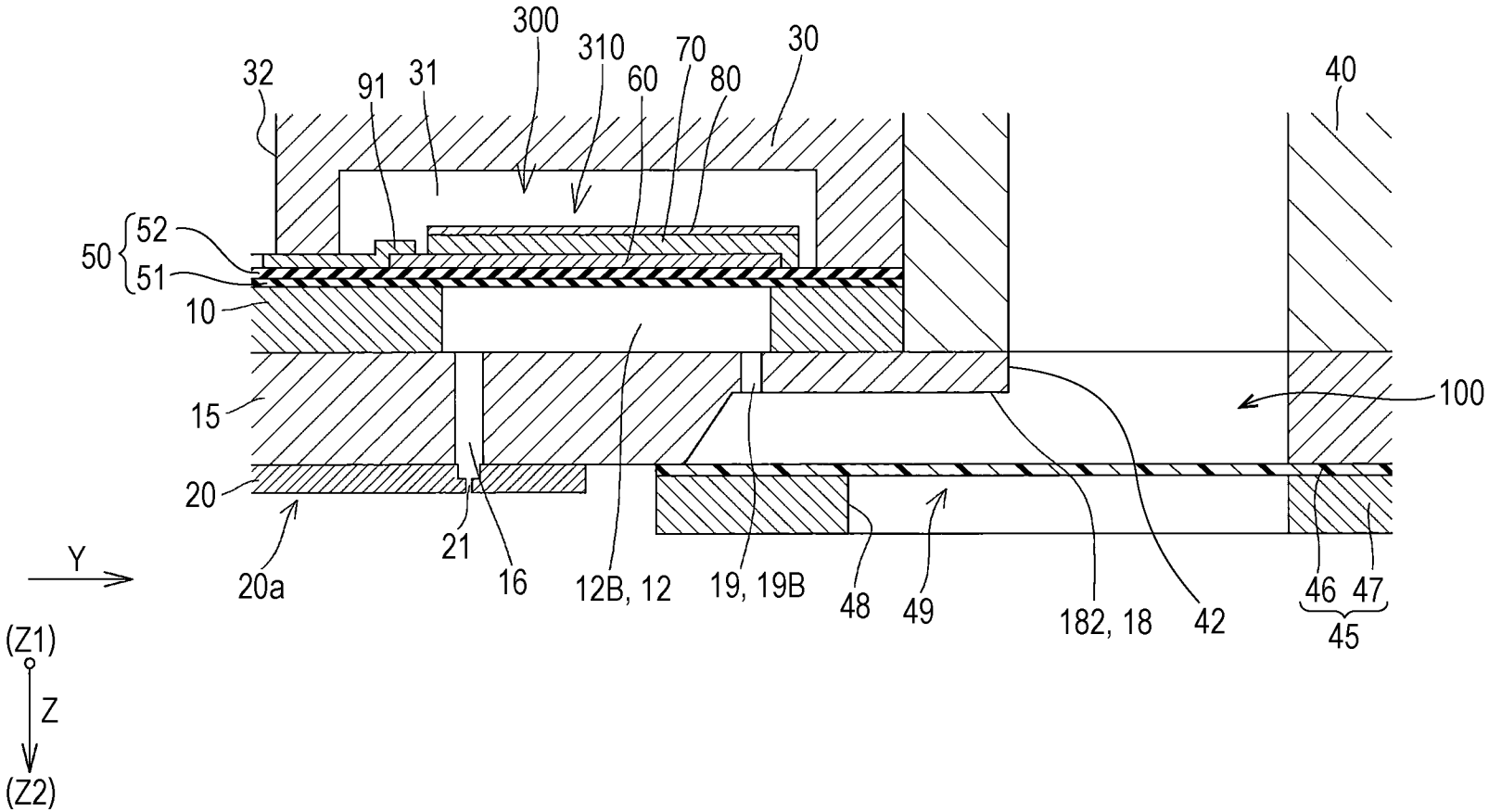
FIG. 5 is a sectional view taken on line V-V in FIG. 2.
Figure 6:
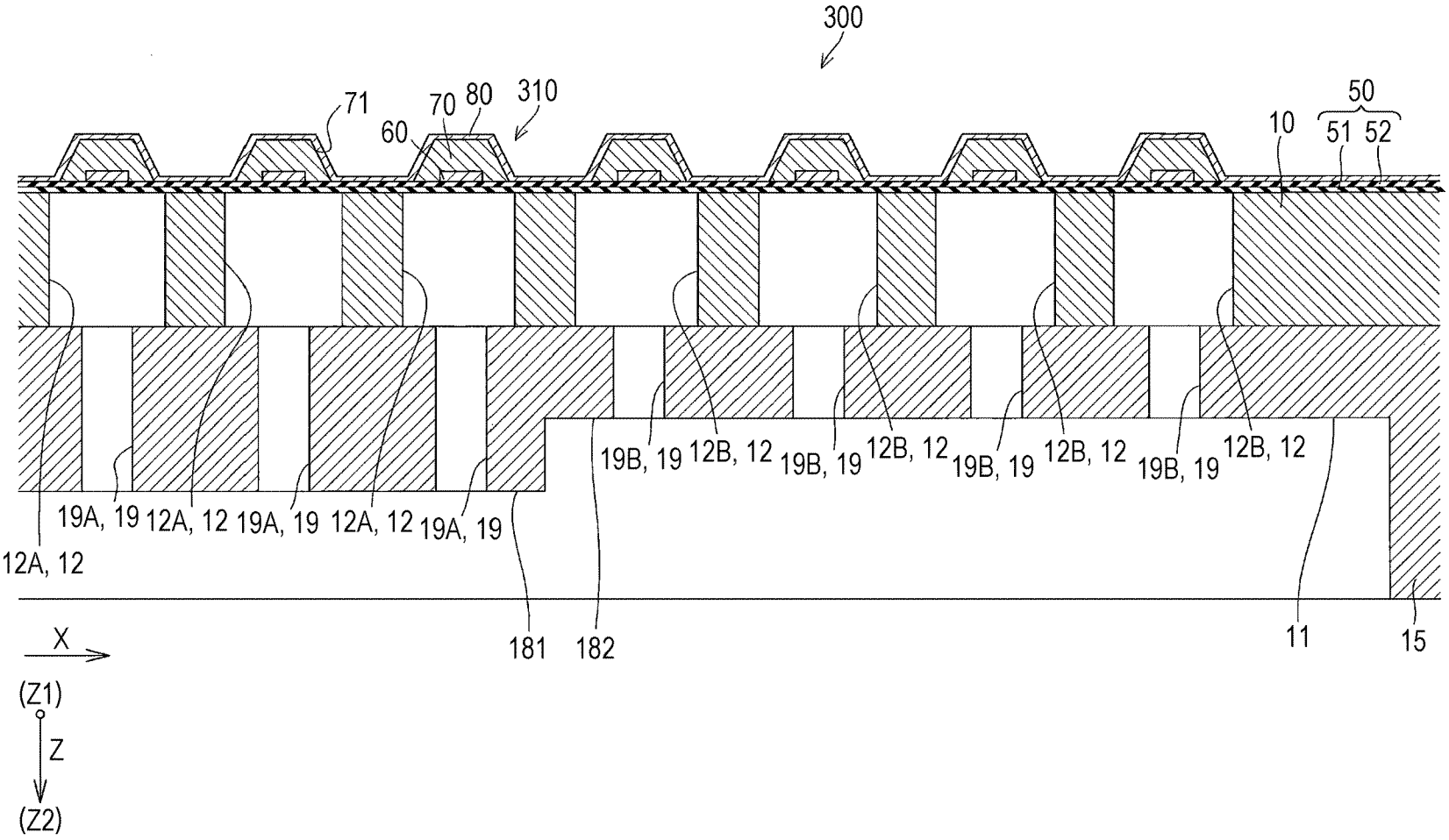
FIG. 6 is a sectional view taken on line VI-VI in FIG. 2.
Figure 7:
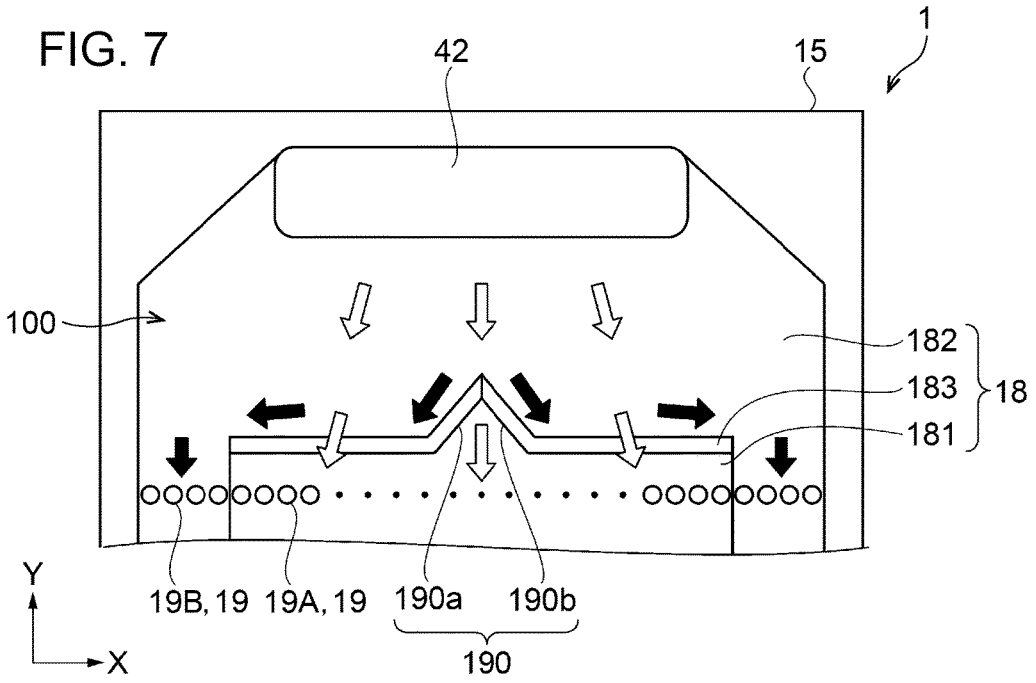
FIG. 7 is a plan view of a flow path formation substrate.

FIG. 1 is an exploded perspective view of a liquid ejecting head according to Exemplary Embodiment 1. FIG. 2 is a plan view of portions of a pressure chamber formation substrate of the liquid ejecting head. FIG. 3 is a sectional view taken on line III-III in FIG. 2. FIG. 4 is an enlarged view of portions shown in FIG. 3. FIG. 5 is a sectional view taken on line V-V in FIG. 2. FIG. 6 is a sectional view taken on line VI-VI in FIG. 2. FIG. 7 is a plan view of a flow path formation substrate. A construction of a liquid ejecting head will be described with reference to FIG. 1 to FIG. 7. In this exemplary embodiment, an ink jet type recording head equipped with piezoelectric actuators will be described as an example of a liquid ejecting head.

As depicted, a pressure chamber formation substrate 10 that constitutes a liquid ejecting head 1 of this exemplary embodiment is provided with pressure chambers 12 disposed side by side. The pressure chambers 12 communicate with nozzle holes 21 provided as nozzles that discharge ink as a liquid. More specifically, by anisotropically etching the pressure chamber formation substrate 10 from one of two side surfaces, the pressure chambers 12 separated by a plurality of partition walls 11 are provided side by side in a direction in which the ink-ejecting nozzle holes 21 are disposed side by side. In the following description, the direction in which the pressure chambers 12 are disposed side by side will be referred to as "side-by-side direction" or "X-axis direction". Furthermore, in the pressure chamber formation substrate 10, the pressure chambers 12 disposed side by side in the X-axis direction are provided in a plurality of rows and, in this exemplary embodiment, two rows. A row-to-side-by-side direction in which a plurality of rows of pressure chambers 12 are arranged will be hereinafter referred to as "Y-axis direction". Furthermore, a gravity direction orthogonal to both the X-axis direction and the Y-axis direction will be referred to as "Z-axis direction. Furthermore, in the Z-axis direction, a case member 40 side described later will be referred to also as "Z1 side" and a nozzle plate 20 will be referred to also as "Z2 side". Although the X-axis direction, the Y-axis direction, and the Z-axis direction are herein defined as mutually orthogonal directions, this is not restrictive. The X-axis direction, the Y-axis direction, and the Z-axis direction may also be directions that intersect one another at angles other than a right angle. On a Z2-side surface of the pressure chamber formation substrate 10 there are a flow path formation substrate 15 and a nozzle plate 20 stacked in order. The nozzle plate 20 is provided with the nozzle holes 21.

As illustrated in FIG. 3 and FIG. 4, the flow path formation substrate 15 is provided between the pressure chamber formation substrate 10 and the nozzle plate 20. The flow path formation substrate 15 is provided with nozzle communication paths 16 that provide communication between the pressure chambers 12 and the nozzle holes 21. The flow path formation substrate 15 has a larger area than the pressure chamber formation substrate 10. The nozzle plate 20 has a smaller area than the pressure chamber formation substrate 10. Because the flow path formation substrate 15 is provided in this manner, the nozzle holes 21 of the nozzle plate 20 are placed apart from the pressure chambers 12 so that the ink in the pressure chambers 12 are less easily affected by increased viscosity of the ink in the vicinity of the nozzle holes 21 which is caused by evaporation of moisture from the ink. Furthermore, because the nozzle plate 20 needs only to cover openings of the nozzle communication paths 16 that provide communication between the pressure chambers 12 and the nozzle holes 21, the area of the nozzle plate 20 can be made small and, therefore, costs can be reduced. Incidentally, in this exemplary embodiment, a surface of the nozzle plate 20 in which the nozzle holes 21 have openings and from which ink droplets are discharged will be referred to as "liquid ejection surface 20*a*".

Furthermore, the flow path formation substrate 15 has a plurality of individual communication paths 19 that supply the ink as a liquid to the pressure chambers 12 disposed side by side, common liquid chambers 100 each of which communicates with a plurality of pressure chambers 12, liquid introduction ports 42 that introduce the ink into the common liquid chambers 100, and flow paths 18 for the ink flowing from the liquid introduction port 42 toward the individual communication paths 19.

The common liquid chamber 100 is provided outside the nozzle communication paths 16 in the Y-axis direction. The common liquid chambers 100 are formed by etching the flow path formation substrate 15 from the nozzle plate 20 side (Z2 side) into recessed configurations and sealing openings of the recessed configurations. That is, the flow path formation substrate 15 is located on a pressure formation substrate side (Z1 side) of the common liquid chambers 100. The flow path formation substrate 15 that forms the common liquid chambers 100 has thick wall portions 181 whose substrate thickness is great and thin wall portions 182 whose substrate thickness is small.

Furthermore, a compliance substrate 45 is provided on a Z2-side surface of the flow path formation substrate 15 in which the common liquid chambers 100 have openings. This compliance substrate 45 seals the liquid ejection surface 20*a*-side openings of the recessed configurations of the common liquid chambers 100. In this exemplary embodiment, this compliance substrate 45 includes a sealing film 46 made of a thin film having flexibility and a fixture substrate 47 made of a hard material such as a metal. Portions of the fixture substrate 47 which face the common liquid chambers 100 have been removed completely in the thickness direction to form opening portions 48. Therefore, a one-surface-side portion of each common liquid chamber 100 forms a compliance portion 49 that is a flexible portion sealed only by the sealing film 46 that has flexibility. Therefore, the flow paths 18 for the ink moving from the liquid introduction ports 42 to the individual communication paths 19 are defined by the sealing film 46.

The individual communication paths 19 provide communication between the common liquid chambers 100 and the pressure chambers 12. Each of the individual communication paths 19 is provided at one side (a nozzle communication path 16 side) of a corresponding one of the common liquid chambers 100 in the Y-axis direction. Each of the individual communication paths 19 communicate with an end portion of one of the pressure chambers 12 in the Y-axis direction. That is, the individual communication paths 19 are formed in the flow path formation substrate 15, corresponding one-to-one to the pressure chambers 12. Specifically, the individual communication paths 19 are disposed side by side in the side-by-side direction (X-axis direction).

The liquid introduction port 42 of each common liquid chamber 100 is located at another side of the common liquid chamber 100 in the Y-axis direction (the opposite side thereof to the individual communication paths 19), and penetrates the flow path formation substrate 15 in the Z-axis direction. In this exemplary embodiment, as illustrated in FIGS. 1 and 3, two constructions that each include a common liquid chamber 100 and pressure chambers 12, various paths, etc. connected to the common liquid chamber 100 in this exemplary embodiment are symmetrical and substantially the same; therefore, descriptions regarding these two symmetrical constructions below will be made with regard to only one of the two, as appropriate.

The ink introduced from the liquid introduction port 42 into the common liquid chamber 100 moves through the flow path 18 extending from the liquid introduction port 42 to the individual communication path 19 side along the Y-axis direction and is supplied through the individual communication paths 19 into the pressure chambers 12, which correspond one-to-one to the nozzle holes 21. Because of the thick wall portion 181, the area of a cross-section of the flow path 18 taken along a thickness direction of the flow path formation substrate 15 (Z-axis direction) is smaller at the individual communication path 19 side than at the liquid introduction port 42 side. That is, in the Y-axis direction, the thin wall portion 182 partially defining the flow path 18 is formed at the liquid introduction port 42 side of the common liquid chamber 100 and the thick wall portion 181 is formed at the individual communication path 19 side of the common liquid chamber 100. The thick wall portion 181 has an elongated, substantially rectangular shape in the side-by-side direction (X-axis direction). A boundary portion 183 between the thin wall portion 182 and the thick wall portion 181 in the Y-axis direction is sloped obliquely downward (to the positive Z side) from the thin wall portion 182 to the thick wall portion 181 in a side view from the X-axis direction. This strengthens the flow of the ink from the thin wall portion 182 to the thick wall portion 181.

As illustrated in FIGS. 5 to 7, individual communication paths 19 (19B) located at both end sides in the side-by-side direction (X-axis direction) are formed in the thin wall portion 182 and individual communication paths 19 (19A) located not at the end sides are formed in the thick wall portion 181. Specifically, dummy individual communication paths 19B located at the end sides in the side-by-side direction in which the pressure chambers 12 are disposed side by side have openings in a positive Z-side bottom surface of the thin wall portion 182 (a ceiling surface of the common liquid chamber 100). In other words, the thick wall portion 181 is not provided at the end sides of the common liquid chamber 100 in the side-by-side direction. Droplet-discharging individual communication paths 19A located not at the end sides have openings in the bottom surface of the thick wall portion 181 (see FIG. 4).

As illustrated in FIG. 6, the droplet-discharging individual communication paths 19A having openings in the bottom surface of the thick wall portion 181 communicate with droplet-discharging pressure chambers 12A while the dummy individual communication paths 19B having openings in the bottom surface of the thin wall portion 182 communicate with dummy pressure chambers 12B. The dummy pressure chambers 12B are pressure chambers 12 communicating with the nozzle holes 21 that are not used to discharge ink drops when characters and images are printed by landing ink droplets on an ejection target medium such as paper or a recording sheet. The droplet-discharging pressure chambers 12A are pressure chambers 12 communicating with the nozzle holes 21 that are used to discharge ink droplets for printing. Ink is discharged from the nozzle holes 21 communicating with the dummy pressure chambers 12B at the time of cleaning. Examples of the cleaning include a flushing operation in which ink droplets are discharged from the nozzle holes 21, a suction cleaning operation in which the nozzle holes 21 are covered with a cap and the inside of the cap is made to have a negative pressure by using a suction pump or the like so that undesired matters, such as gas bubbles or dust, in the dummy pressure chambers 12B and the common liquid chambers 100 are sucked out together with the ink through the nozzle holes 21, and like operations.

In this exemplary embodiment, of the pressure chambers 12 disposed side by side in the side-by-side direction (X-axis direction), one or more pressure chamber 12 at each end sides in the X-axis direction are the dummy pressure chambers 12B and the other pressure chambers 12 are the droplet-discharging pressure chambers 12A. Note that although the liquid ejecting head 1 in illustrated in FIGS. 6 and 7 has a construction in which each of the two end sides in the X-axis direction is provided with four dummy pressure chambers 12B and four dummy individual communication paths 19B communicating with the dummy pressure chambers 12B, the liquid ejecting head 1 may have a construction in which one dummy pressure chamber 12B and one dummy individual communication path 19B are provided or may also have a construction in which the number of dummy pressure chambers 12B and the number dummy individual communication paths 19B are two or more.

As illustrated in FIG. 4 to FIG. 7, the individual communication paths 19 that provide communication between the pressure chambers 12 and the common liquid chamber 100 are linearly disposed side by side in the side-by-side direction (X-axis direction). Furthermore, as described above, the droplet-discharging individual communication paths 19A that provide communication between the droplet-discharging pressure chambers 12A and the common liquid chamber 100 have openings in the bottom surface of the thick wall portion 181 while the dummy individual communication paths 19B that provide communication between the dummy pressure chambers 12B and the common liquid chamber 100 have bottom surface of the thin wall portion 182. Specifically, the thin wall portion 182 is formed where, of the individual communication paths 19, the dummy individual communication paths 19B have openings. That is, since the individual communication paths 19 are disposed side by side in the side-by-side direction, the thick wall portion 181 is provided in a middle region in the side-by-side direction of the individual communication paths 19 while the thin wall portion 182 extends to the two end sides in the side-by-side direction of the individual communication paths 19. Because the droplet-discharging individual communication paths 19A have openings in the bottom surface of the thick wall portion 181 and the dummy individual communication paths 19B have openings in the bottom surface of the thin wall portion 182 in this manner, the droplet-discharging individual communication paths 19A can certainly have a greater length than the dummy individual communication paths 19B.

Because the droplet-discharging individual communication paths 19A have openings in the bottom surface of the thick wall portion 181, the length of the droplet-discharging individual communication paths 19A can be appropriately set to a necessary length without being affected by the thickness of the thin wall portion 182. Specifically, it is possible to secure a length of the droplet-discharging individual communication paths 19A, reduce the pressure loss in the droplet-discharging individual communication paths 19A, and therefore improve the discharge efficient in discharging ink from the nozzle holes 21. Note that the pressure loss in the droplet-discharging individual communication paths 19A is determined by the length and opening diameter of the droplet-discharging individual communication paths 19A and reduction of the opening diameter of the droplet-discharging individual communication paths 19A is technically limited. Therefore, in the case where the discharge efficiency is not sufficient due to the opening diameter of the droplet-discharging individual communication paths 19A, a longer length thereof needs to be secured to improve the discharge efficiency.

In this exemplary embodiment, the droplet-discharging individual communication paths 19A have openings in the bottom surface of the thick wall portion 181 having a greater thickness than the thin wall portion 182. Therefore, even when it is difficult to reduce the opening diameter of the droplet-discharging individual communication paths 19A, the discharge efficient can be improved by securing a longer length of the droplet-discharging individual communication paths 19A. Furthermore, due to the provision of the thin wall portion 182 thinner than the thick wall portion 181 in which the droplet-discharging individual communication paths 19A have openings, a preferred capacity of the common liquid chambers 100 can be secured to reduce the pressure loss in the common liquid chamber 100 and therefore improve the discharge efficiency. Due to adoption of this construction, even when there is a tendency of reduced thickness of the flow path formation substrate 15 in the Z-axis direction, a preferred length of the droplet-discharging individual communication paths 19A and a preferred capacity of the common liquid chambers 100 can both be achieved. Therefore, it is possible to reduce the size of the liquid ejecting head 1 without degrading the ink discharge characteristic, that is, without adversely affecting the liquid discharge characteristic. Furthermore, since the dummy individual communication paths 19B have openings in the bottom surface of the thin wall portion 182 and therefore have a reduced length, the flow path resistance of the dummy individual communication paths 19B can be made less than the flow path resistance of the droplet-discharging individual communication paths 19A.

As illustrated in FIG. 7, the thick wall portion 181 has a first inclined portion 190 that, in a plan view from the nozzle plate 20 side, is inclined from the liquid introduction port 42 side to at least one of the end sides of the plurality of individual communication paths 19 formed in the side-by-side direction in which the pressure chambers 12 are disposed side by side. FIG. 7 illustrates a plan view from the nozzle plate 20 side. In this exemplary embodiment, the first inclined portion 190 of the thick wall portion 181 is made up of a first side portion 190*a* and a second side portion 190*b* and is protruded in a triangular shape toward a center of the liquid introduction port 42 in the side-by-side direction. The first side portion 190*a* is inclined from its distal end protruded to the liquid introduction port 42 side toward one of the two ends (i.e., a negative X-side end) of the row of the individual communication paths 19 disposed side by side in the side-by-side direction (X-axis direction). The second side portion 190*b* is inclined from its distal end protruded to the liquid introduction port 42 side toward the other one of the two ends (i.e., a positive X-side end) of the row of the individual communication paths 19 disposed side by side in the side-by-side direction.

The ink introduced from the liquid introduction port 42 into the common liquid chamber 100 spreads in a fan shape from the liquid introduction port 42 in the side-by-side directions (the positive and negative X-axis directions) as the ink flows through the flow path 18 from the liquid introduction port 42 toward the individual communication paths 19. Even when the thick wall portion 181 is formed, the ink can flow under the bottom surface (positive Z-side surface) of the thick wall portion 181 and reach the droplet-discharging individual communication paths 19A. In FIG. 7, flowing directions of ink are indicated by hollow arrows.

Now, movements of gas bubbles in the case where the thick wall portion 181 is not provided with the first inclined portion 190 will be described.

Gas bubbles in the ink introduced from the liquid introduction port 42 into the common liquid chamber 100 rise upward in the vertical direction (the negative Z-axis direction) due to buoyancy and move together with the ink toward the individual communication paths 19 along the bottom surface of the thin wall portion 182 while spreading in a fan shape. In the case where the first inclined portion 190 is not provided, the boundary portion 183 between the thick wall portion 181 and the thin wall portion 182 is formed substantially parallel with the side-by-side direction (X-axis direction). When gas bubbles carried in oblique flows of ink spreading in a fan shape reach the boundary portion 183, that is, when flows of ink intersect the boundary portion 183 extending in the X-axis direction at acute or obtuse angles, the gas bubbles cannot go over a step of the boundary portion 183 but are temporarily stopped by the boundary portion 183. Then, the gas bubbles can be carried by oblique liquid flows along the boundary portion 183 and the bottom surface of the thin wall portion 182 to the end sides in the side-by-side direction. However, when gas bubbles carried by flows of ink flowing from a center of the liquid introduction port 42 in the side-by-side direction into the common liquid chamber 100 and flowing substantially orthogonally to the side-by-side direction reach the boundary portion 183, that is, when the ink flow direction is substantially orthogonal to the boundary portion 183 extending in the X-axis direction, the gas bubbles are pushed against the step of the boundary portion 183 by the orthogonal liquid flows. That is, there is a risk that gas bubbles cannot move to either end side of the row of the individual communication paths 19 but reside on a central portion of the boundary portion 183. There is a method for inhibiting gas bubbles from residing by changing flowing directions of ink through the provision of a columnar obstacle between the liquid introduction port 42 and the thick wall portion 181. However, in this exemplary embodiment, since the common liquid chamber 100 is formed by making a hole in the flow path formation substrate 15 and sealing the opening of the hole with the flexible sealing film 46, it is difficult to provide a columnar obstacle in the common liquid chamber 100.

In this exemplary embodiment, the thick wall portion 181 is provided with the first inclined portion 190 protruded in a triangular shape toward a center of the liquid introduction port 42 so that the boundary portion 183 intersects, at acute or obtuse angles, flows of ink substantially orthogonal to the side-by-side direction. In other words, the first inclined portion 190 is provided at such a location in the Y-axis direction that the direction of the distal end of the first inclined portion 190 substantially coincides with the direction of flows of ink substantially orthogonal to the side-by-side direction. When gas bubbles carried by flows of ink substantially orthogonal to the side-by-side direction reach the triangularly protruded first inclined portion 190, the gas bubbles then move along the first side portion 190*a* or the second side portion 190*b* and spread in either one of the opposite side-by-side directions to reach the boundary portion 183 extending in the X-axis direction. After that, by oblique liquid flows spreading in a fan shape, the gas bubbles can be carried along the bottom surface of the thin wall portion 182 and the boundary portion 183 to the end sides in the side-by-side direction. In this manner, gas bubbles are prevented from residing on the boundary portion 183 between the thick wall portion 181 and the thin wall portion 182, so that the amount of ink supplied from the droplet-discharging individual communication paths 19A to the droplet-discharging pressure chambers 12A becomes stable. In FIG. 7, directions of movement of gas bubbles are indicated by solid arrows.

Gas bubbles carried to the both end sides of the individual communication paths 19 can be emitted out through the dummy individual communication paths 19B provided on the bottom surface of the thin wall portion 182.

As stated above, the flow path resistance of the dummy individual communication paths 19B is less than the flow path resistance of the droplet-discharging individual communication paths 19A. Therefore, when suction cleaning is performed by sucking from all the nozzle holes 21, the amounts of flow passing through the dummy individual communication paths 19B are relatively large, among the paths extending from the common liquid chamber 100 to the nozzle holes 21 through the individual communication paths 19. Therefore, gas bubbles contained in the ink in the common liquid chamber 100 are emitted from the nozzle holes 21 connected to the dummy individual communication paths 19B having a relatively low flow path resistance.

Furthermore, since the dummy individual communication paths 19B have openings in the bottom surface of the thin wall portion 182, the ink supplied into the common liquid chamber 100 and the gas bubbles contained in the ink easily reach the openings of the dummy individual communication paths 19B without moving across the boundary portion 183 (and the thick wall portion 181). In particular, in the case where the pressure chambers 12 are disposed to be higher in the vertical direction than the common liquid chamber 100, the gas bubbles contained in ink, which move upward in the vertical direction due to buoyancy, do not easily move down in the vertical direction and cross the boundary portion 183 (and the thick wall portion 181), so that it is difficult for the gas bubbles to reach the openings of the droplet-discharging individual communication paths 19A.

Therefore, the gas bubbles contained in the ink in the common liquid chamber 100 move, due to buoyancy and flows of the ink, along the bottom surface of the thin wall portion 182 (the ceiling surface in the vertical direction) and the boundary portion 183, so that it is easy for the gas bubbles to reach the dummy individual communication paths 19B having openings in portions of the thin wall portion 182 that are located at the two ends in the side-by-side direction. Hence, the gas bubbles contained in the ink in the common liquid chamber 100 can be easily emitted from the nozzle holes 21 connected to the dummy individual communication paths 19B via the dummy pressure chambers 12B, so that the capability of emitting gas bubbles improves. Furthermore, since the gas bubbles contained in the ink can be inhibited from entering the droplet-discharging pressure chambers 12A through the droplet-discharging individual communication paths 19A, the incomplete discharge of ink droplets caused by gas bubbles entering the droplet-discharging pressure chambers 12A can be inhibited.

Although in the foregoing description, the suction cleaning is performed on all the nozzle holes 21, the suction cleaning may be performed only on the nozzle holes 21 that communicate with the dummy pressure chambers 12B. That is, a suction unit that perform suction operation only on the nozzle holes 21 that communicate with the dummy pressure chambers 12B may be provided. The suction unit may be a well-known unit that includes a cap for covering the nozzle holes 21 by coming into contact with the liquid ejection surface 20*a* and a suction device, such as a suction pump, that produces a negative pressure inside the cap by suction. Incidentally, in the case where the suction unit performs suction from only the nozzle holes 21 that communicate with the dummy pressure chambers 12B, use of a cap that covers only the nozzle holes 21 communicating with the dummy pressure chambers 12B will suffice. Furthermore, in the case where the cap covers all the nozzle holes 21, further provision of a closure unit that closes the nozzle holes 21 other than the nozzle holes communicating with the dummy pressure chambers 12B will suffice. Thus, even in the case where the suction cleaning is performed only on the nozzle holes 21 communicating with the dummy pressure chambers 12B, gas bubbles in the ink can be efficiently emitted from the low-flow path resistance dummy individual communication paths 19B. Furthermore, in this exemplary embodiment, the dummy individual communication paths 19B are provided in both end areas in the X-axis direction in which the individual communication paths 19 are disposed side by side in a row. Because of this, the gas bubbles moving to the two ends of the row of the individual communication paths 19 by following the first inclined portion 190 and the boundary portion 183 in the common liquid chamber 100 are emitted from the dummy individual communication paths 19B, so that the capacity of emitting gas bubbles from the common liquid chamber 100 can be further improved. Although in the foregoing description, the first inclined portion 190 has a triangular shape partially defined by the first side portion 190*a* and the second side portion 190*b*, the first side portion 190*a* and the second side portion 190*b* may be curved portions.

As illustrated in FIG. 3 and FIG. 5, the nozzle plate 20 is joined to the nozzle communication paths 16 that have openings in the Z2-side surface of the flow path formation substrate 15. The nozzle plate 20 is provided with the nozzle holes 21 communicating with the corresponding pressure chambers 12 through the nozzle communication paths 16. The nozzle holes 21 eject the same kind of liquid (ink) and are disposed side by side along the side-by-side direction (X-axis direction). The nozzle holes 21 disposed side by side in the X-axis direction are provided in two rows that are arranged in the Y-axis direction (the row-to-side-by-side direction).

On the other hand, the Z1-side surface of the pressure chamber formation substrate 10 is provided with a vibration plate 50. In this exemplary embodiment, as the vibration plate 50, there are provided an elastic film 51 made of silicon oxide that is provided on the pressure chamber formation substrate 10 side and an insulator film 52 made of zirconium oxide that is provided on the elastic film 51. Incidentally, liquid flow paths, such as the pressure chambers 12, are formed by anisotropically etching the pressure chamber formation substrate 10 from one of two surface sides (from the side of the surface to which the nozzle pate 20 is joined). The other surface of each pressure chamber 12 is defined by the elastic film 51.

Furthermore, on the vibration plate 50 on the pressure chamber formation substrate 10, piezoelectric actuators 300 are formed by stacking first electrodes 60, piezoelectric substance layers 70, and second electrodes 80 by film formation and a lithography process. In this exemplary embodiment, the piezoelectric actuators 300 are pressure generation units that cause pressure changes in the ink in the pressure chambers 12. Note that the piezoelectric actuators 300 are also termed piezoelectric elements and refer to portions that include the first electrodes 60, the piezoelectric substance layers 70, and the second electrodes 80. Portions that produce a piezoelectric strain in the piezoelectric substance layers 70 when voltage is applied between the first electrodes 60 and the second electrode 80 are referred to as "active portions 310". In this exemplary embodiment, the active portions 310 are formed separately for each of the pressure chambers 12, as described in detail below. That is, a plurality of active portions 310 are formed on the pressure chamber formation substrate 10. Generally, one of the two electrodes of each active portion 310 is provided as an individual electrode independent of those of the other active portions 310 and the other electrode of each active portion 310 is provided as a common electrode that is shared with the other active portions 310. In this exemplary embodiment, the first electrodes 60 of the active portions 310 are provided as individual electrodes and the second electrodes 80 of the active portions 310 are provided as common electrodes. This arrangement may be reversed. Although in the foregoing example, the vibration plate 50 and the first electrodes 60 function as vibration plates, this construction is not restrictive. For example, the vibration plate 50 may be omitted and only the first electrodes 60 may operate as vibration plates. Furthermore, it is also permissible to adopt a construction in which each piezoelectric actuator 300 itself operates substantially as a vibration plate as well.

Note that the first electrodes 60 constituting the piezoelectric actuators 300 in this exemplary embodiment are separated for each of the pressure chambers 12 and form mutually independent individual electrodes separately for each of the active portions 310, which are effective driving units of the piezoelectric actuators 300. The width of the first electrodes 60 in the X-axis direction, which is the side-by-side direction of the pressure chambers 12, is smaller than the width of the pressure chambers 12 in the X-axis direction. Specifically, in the X-axis direction, end portions of the first electrodes 60 are located inside regions that face the pressure chambers 12. In the Y-axis direction, end portions of the first electrodes 60 extend beyond ends of the pressure chambers 12.

Piezoelectric substance layers 70 extend continuously in the X-axis direction with a predetermined width in the Y-axis direction. The width of the piezoelectric substance layers 70 in the Y-axis direction is greater than the length of the pressure chambers 12 in the Y-axis direction. In the Y-axis direction, which is the row-to-side-by-side direction of the pressure chambers 12, each piezoelectric substance layer 70 extends farther outward than the corresponding pressure chambers 12.

In the Y-axis direction (the row-to-row direction of the pressure chambers 12), the individual communication path 19-side ends of the piezoelectric substance layers 70 are located outwardly of the individual communication path 19-side ends of the first electrodes 60. That is, the end portions of the first electrodes 60 are covered by the piezoelectric substance layers 70. Furthermore, the nozzle hole 21-side ends of the piezoelectric material layers 70 are located inwardly (at the pressure chamber 12 side) of the nozzle hole 21-side ends of the first electrodes 60. That is, the nozzle hole 21-side ends of the first electrodes 60 are not covered by the piezoelectric substance layers 70.

The piezoelectric substance layers 70 are made of a piezoelectric material that is an oxide having a polarized structure formed on the first electrodes 60. For example, the piezoelectric substance layers 70 may be made of a perovskite-type oxide represented by a general formula $ABO_3$. A lead-based piezoelectric material that contains lead, a non-lead-based piezoelectric material that does not contain lead, etc., may be used.

Each piezoelectric substance layer 70 is provided with recess portions 71 that correspond to individual partition walls. The width of each recess portion 71 in the X-axis direction is substantially equal to or greater than the width of each partition wall in the X-axis direction. Due to this, portions of the vibration plate 50 that face the end portions of the pressure chambers 12 in the Y-axis direction (so-called arm portions of the vibration plate 50) can have a reduced rigidity, so that each piezoelectric actuator 300 can be favorably displaced.

Each second electrode 80 is provided on the opposite side surface of the piezoelectric substance layer 70 to the first electrodes 60 and forms a common electrode that is common to a plurality of active portions 310. Furthermore, the second electrodes 80 may be formed so as to either extend or not extend over inside surfaces of the recess portions 71, that is, in side surfaces of the recess portions 71 of the piezoelectric substance layers 70.

Furthermore, individual wires 91 that are lead wires are led out from the first electrodes 60 of the piezoelectric actuators 300. A common wire 92 that is a lead wire is led out from each second electrode 80. Opposite end portions of the individual wires 91 and the common wires 92 to their connections to the piezoelectric actuators 300 extend away from the piezoelectric actuators 300 are connected to a flexible cable 120. The flexible cable 120 is a wiring substrate that has flexibility and, in this embodiment, is provided with a drive circuit 121 that is a driving element and that is mounted on the flexible cable 120.

A protective substrate 30 is joined to the Z1-side surface of the pressure chamber formation substrate 10 constructed as described above. The protective substrate 30 has substantially the same size as the pressure chamber formation substrate 10. The protective substrate 30 has holder portions 31 that are spaces for protecting the piezoelectric actuators 300. Two holder portions 31 are formed side by side in the Y-axis direction between the two rows of the piezoelectric actuators 300 disposed side by side in the X-axis direction. Furthermore, the protective substrate 30 has a through hole 32 between the two holder portions 31 disposed side by side in the Y-axis direction. The through hole 32 penetrates the protective substrate 30 in the Z-axis direction. The end portions of the individual wires 91 and the common wires 92 that are led out from electrodes of the piezoelectric actuators 300 extend to be exposed in the through hole 32. The individual wires 91 and the common wires 92 are electrically connected to the flexible cable 120 within the through hole 32. The connecting method for the individual wires 91, the common wires 92, and the flexible cable 120 is not particularly limited; for example, soldering, brazing, eutectic bonding, welding, an electroconductive adhesive containing electroconductive particles (ACP, ACF), a non-electroconductive adhesive (NCP, NCF), etc. can be cited.

A case member 40 is fixed to the protective substrate 30. The case member 40 and the pressure chamber formation substrate 10 together define the common liquid chambers 100 that communicate with the plurality of pressure chambers 12. The case member 40 has substantially the same shape as the foregoing flow path formation substrate 15 in a plan view. The case member 40 is joined to the protective substrate 30 and also joined to the foregoing flow path formation substrate 15. Concretely, the case member 40 has on a protective layer 30 side a recess portion 41 that has a depth that allows the pressure chamber formation substrate 10 and the protective substrate 30 to be housed in the recess portion 41. This recess portion 41 has an opening area that is larger than the area of a face of the protective substrate 30 joined to the pressure chamber formation substrate 10. A nozzle plate 20-side opening surface of the recess portion 41 is sealed by the flow path formation substrate 15, with the pressure chamber formation substrate 10 and the like housed in the recess portion 41. Therefore, the liquid introduction ports 42 in outer perimeter portions of the pressure chamber formation substrate 10 are defined by the case member 40.

The case member 40 is provided with introduction paths 44 communicating with the common liquid chambers 100 to supply ink to the common liquid chambers 100. The case member 40 further has a connecting hole 43 which communicates with the through hole 32 of the protective substrate 30 and into which the flexible cable 120 is inserted.

In the liquid ejecting head 1 constructed as described above, when ink is ejected, ink is taken through the introduction paths 44 to fill the flow paths extending from the liquid introduction ports 42 to the nozzle holes 21. Then, according to signals from the drive circuit 121, voltage is applied to the active portions 310 that correspond to predetermined the droplet-discharging pressure chamber 12A, so that, together with the active portions 310, the vibration plates 50 undergo flexure deformation. Therefore, the pressure in the droplet-discharging pressure chambers 12A increases so that ink droplets are ejected from the corresponding nozzle holes 21.

Although in this exemplary embodiment, the thin film-type piezoelectric actuators 300 are used as an example of pressure generation units that cause pressure changes in the pressure chambers 12 are, this arrangement does not limit the invention. For example, it is possible to use thick film-type piezoelectric actuators formed by, for example, a method in which a green sheet is stuck, longitudinal vibration-type piezoelectric actuators that are formed by alternately stacking piezoelectric materials and electrode formation materials and that are expanded and contracted in their axis directions, etc. Furthermore, the pressure generation unit may be a pressure generation unit in which a heating element is disposed in a pressure chamber and the heating element is caused to produce heat that generates a bubble whereby a liquid droplet is discharged from a nozzle hole, a so-called electrostatic actuator in which static electricity is generated between a vibration plate and an electrode and, by electrostatic force, the vibration plate is deformed to discharge a liquid droplet from a nozzle hole.

As described above, the liquid ejecting head 1 according to this exemplary embodiment can achieve the following advantageous effects.

Since the thick wall portions 181 that form the common liquid chambers 100 of the liquid ejecting head 1 are each provided with the first inclined portion 190 protruded toward the center of the liquid introduction port 42, gas bubbles carried by flows of ink substantially orthogonal to the side-by-side direction can move to the end sides in the side-by-side directions while spreading in either one of the opposite side-by-side directions along the first side portion 190*a* or the second side portion 190*b* of the first inclined portion 190. This prevents gas bubbles from residing on the boundary portion 183 between the thick wall portion 181 and the thin wall portion 182, so that the amounts of ink supplied from the droplet-discharging individual communication paths 19A to the droplet-discharging pressure chambers 12A are stable. Therefore, the liquid ejecting head 1 improved in the ink discharging performance can be provided.

The droplet-discharging individual communication paths 19A that provide communication between the common liquid chambers 100 and the droplet-discharging pressure chambers 12A have openings in the bottom surfaces of the thick wall portions 181 while the dummy individual communication paths 19B that provide communication between the common liquid chambers 100 and the dummy pressure chambers 12B have openings in the bottom surfaces of the thin wall portions 182. The gas bubbles contained in move, due to buoyancy and flows of the ink, along the bottom surfaces of the thin wall portions 182 and the boundary portions 183, so that it is easy for the gas bubbles to reach the dummy individual communication paths 19B having openings in portions of the thin wall portion 182 that are located at the both ends in the side-by-side direction. By performing suction cleaning, the gas bubbles can be emitted from the nozzle holes 21 connected to the dummy individual communication paths 19B via the dummy pressure chambers 12B. Therefore, the capability of emitting gas bubbles improves. Furthermore, since the gas bubbles contained in the ink can be inhibited from entering the droplet-discharging pressure chambers 12A through the droplet-discharging individual communication paths 19A, the incomplete discharge of ink droplets caused by gas bubbles entering the droplet-discharging pressure chambers 12A can be inhibited.

Although in Exemplary Embodiment 1, the dummy pressure chambers 12B are pressure chambers 12 communicating with the nozzle holes 21 that are not used to discharge ink drops when characters and images are printed by landing ink droplets on an ejection target medium such as paper or a recording sheet, the dummy pressure chambers 12B may also be used to eject ink droplets to the recording medium when the bubble-caused variations in the amount of liquid supplied from the individual communication paths 19 into the pressure chambers 12 are within an acceptable range.

Exemplary Embodiment 2

Figure 8:
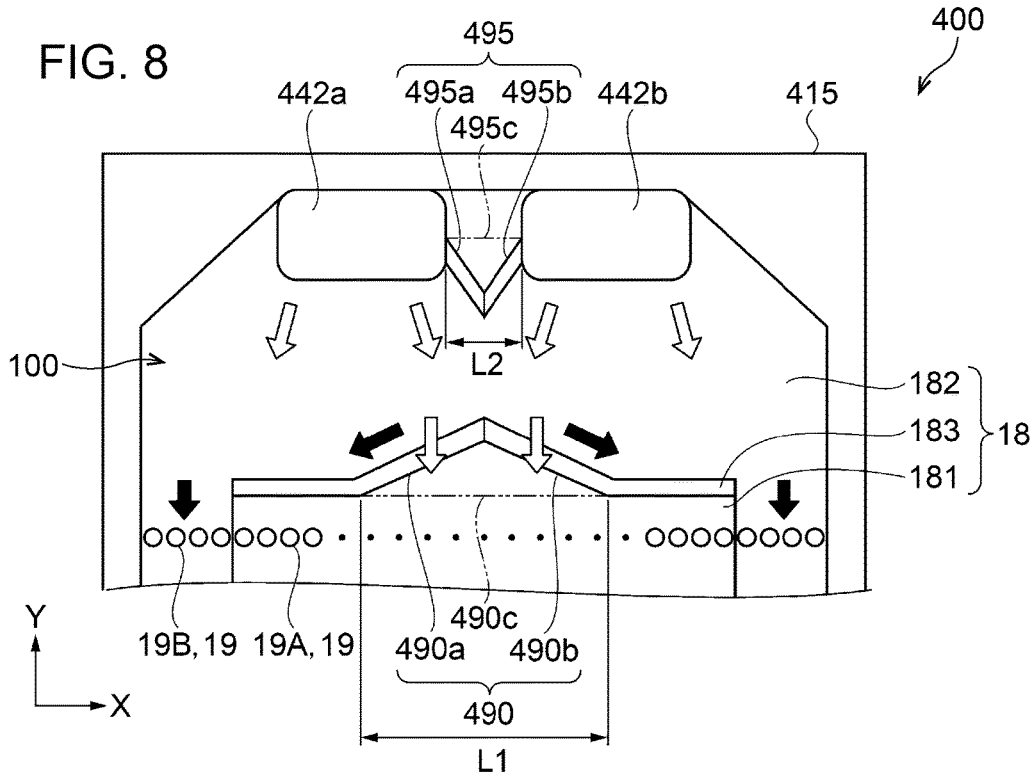
FIG. 8 is a plan view of a flow path formation substrate of a liquid ejecting head according to Exemplary Embodiment 2.

FIG. 8 is a plan view of a flow path formation substrate of a liquid ejecting head according to Exemplary Embodiment 2. A construction of a liquid ejecting head 400 according to this exemplary embodiment will be described with reference to FIG. 8. Note that the same component portions and the like as in Exemplary Embodiment 1 are referenced by the same reference characters and are not redundantly described.

As illustrated in FIG. 8, a flow path formation substrate 415 that constitutes the liquid ejecting head 400 is provided with a plurality of liquid introduction ports 442*a* and 442*b* that are disposed side by side in the side-by-side direction. The liquid introduction ports 442*a* and 442*b* have openings in a bottom surface of a thin wall portion 182 and are provided at the opposite side of the thin wall portion 182 to individual communication paths 19 in the Y-axis direction. A thick wall portion 181 includes a first inclined portion 490 that is made up of a first side portion 490*a* and a second side portion 490*b* and that is protruded in a triangular shape toward a location between the liquid introduction ports 442*a* and 442*b* in the side-by-side direction. The first side portion 490*a* is inclined from its distal end protruded to the side of the liquid introduction ports 442*a* and 442*b* toward one of the two ends (the negative X-side end) of the row of the individual communication paths 19 disposed side by side in the side-by-side direction. The second side portion 490*b* is inclined from its distal end protruded to the liquid introduction ports 442*a* and 442*b* side toward the other one of the two ends (the positive X-side end) of the row of the individual communication paths 19 disposed side by side in the side-by-side direction.

Between the liquid introduction port 442*a* and the liquid introduction port 442*b* there is provided a girder having substantially the same thickness as the thick wall portion 181. The girder is provided with a second inclined portion 495 protruded from the location (girder) between the liquid introduction ports 442*a* and 442*b* toward the first inclined portion 490 in a plan view from a nozzle plate 20 side (positive Z side). The second inclined portion 495 has a maximum thickness substantially equal to the thickness of the thick wall portion 181 and is made up of a first side portion 495*a* and a second side portion 495*b* extending from opposite ends of a base 495*c* that is assumed to extend between the liquid introduction ports 442*a* and 442*b*. The base 495*c*, the first side portion 495*a*, and the second side portion 495*b* form a substantially triangular shape. A distal end formed by the first side portion 495*a* and the second side portion 495*b* is protruded toward the distal end formed by the first side portion 490*a* and the second side portion 490*b* of the first inclined portion 490. The first side portion 495*a* is inclined from the distal end protruded to the first inclined portion 490 side toward one of the two ends (the negative X-side end) of base 495*c* while the second side portion 495*b* is inclined from the distal end protruded to the first inclined portion 490 side toward the other one of the two ends (the positive X-side end) of the base 495*c*. The second inclined portion 495 can reduce disturbance of liquid flow (flow of ink) caused by interference from ink introduced from the liquid introduction ports 442*a* and 442*b* and produce, at a central location in the side-by-side direction (X-axis direction), liquid flows of ink in a direction that intersect the side-by-side direction.

The length of the first inclined portion 490 measured in the side-by-side direction is longer than the length of the second inclined portion 495 measured in the side-by-side direction. More specifically, a length L1 of an opposite side to a vertex formed by the first side portion 490*a* and the second side portion 490*b* of the first inclined portion 490 (hereinafter, referred to as the base 490*c*) is longer than a length L2 of an opposite side (base 495*c*) to a vertex formed by the first side portion 495*a* and the second side portion 495*b* of the second inclined portion 495. The first side portion 490*a* and the second side portion 490*b* of the first inclined portion 490 are provided at such a location in the Y-axis direction that the first side portion 490*a* and the second side portion 490*b* intersect the liquid flows of ink substantially orthogonal to the side-by-side direction that are produced by the second inclined portion 495. In other words, since the length L1 of the base 490*c* of the first inclined portion 490 is longer than the length L2 of the base 495*c* of the second inclined portion 495, the first side portion 490*a* and the second side portion 490*b* of the first inclined portion 490 form a width larger than the width of the liquid flows of ink substantially orthogonal to the side-by-side direction. Because of this, the gas bubbles contained in the ink introduced from the liquid introduction ports 442*a* and 442*b* move to both end sides of the row of the individual communication paths 19, so that the gas bubbles are prevented from residing on the boundary portion 183 between the thick wall portion 181 and the thin wall portion 182.

As described above, the liquid ejecting head 400 according to this exemplary embodiment achieves the following advantageous effects.

Since the flow path formation substrate 415 of the liquid ejecting head 400 is provided with the second inclined portion 495 protruded from between the liquid introduction ports 442*a* and 442*b* toward the first inclined portion 490, the interference of ink introduced from the liquid introduction ports 442*a* and 442*b* can be reduced and, in a central portion in the side-by-side direction (X-axis direction), liquid flows of ink in a direction that intersects the side-by-side direction can be produced.

Since the length L1 of the base 490*c* of the first inclined portion 490 is greater than the length L2 of the base 495*c* of the second inclined portion 495, the gas bubbles contained in ink are prevented from residing on the boundary portion 183 between the thick wall portion 181 and the thin wall portion 182, so that the amounts of ink supplied from the droplet-discharging individual communication paths 19A into the droplet-discharging pressure chambers 12A are stable.

Exemplary Embodiment 3

Figure 9:
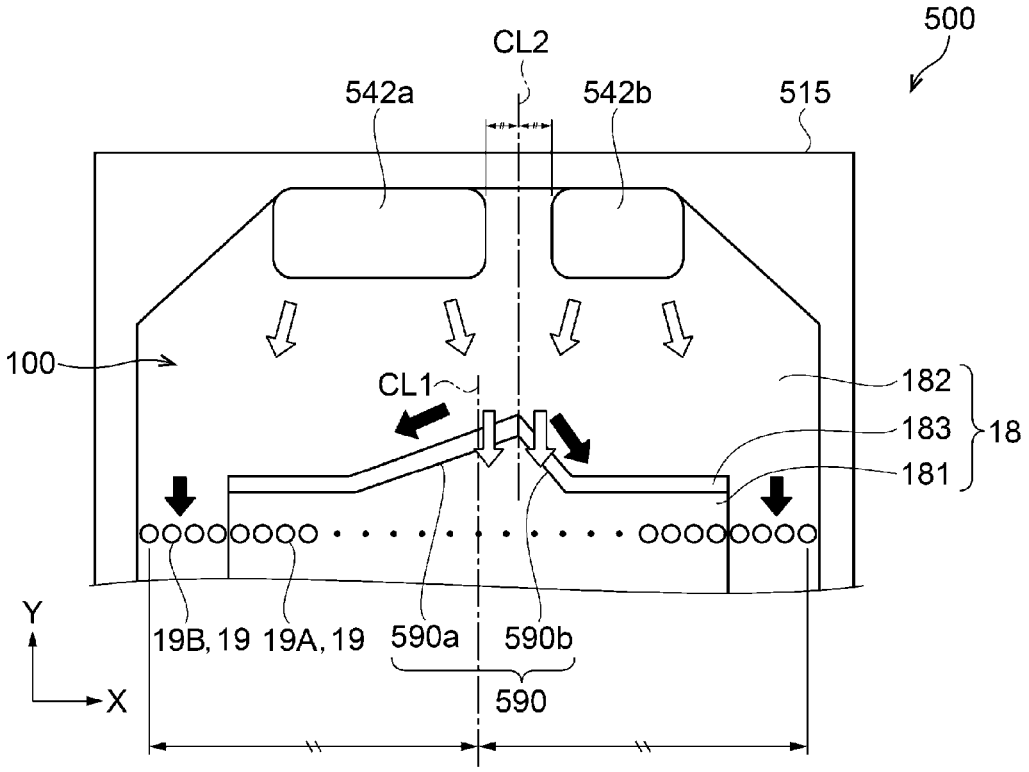
FIG. 9 is a plan view of a flow path formation substrate of a liquid ejecting head according to Exemplary Embodiment 3.

FIG. 9 is a plan view of a flow path formation substrate of a liquid ejecting head according to Exemplary Embodiment 3. A construction of a liquid ejecting head 500 according to this exemplary embodiment will be described with reference to FIG. 9. Note that the same component portions and the like as in Exemplary Embodiment 1 are referenced by the same reference characters and are not redundantly described.

As illustrated in FIG. 9, a flow path formation substrate 515 that constitutes the liquid ejecting head 500 is provided with a plurality of liquid introduction ports 542*a* and 542*b* that are disposed side by side in the side-by-side direction. The liquid introduction ports 542*a* and 542*b* have openings in a bottom surface of a thin wall portion 182 and are provided at the opposite side of the thin wall portion 182 to individual communication paths 19 in the Y-axis direction. Between the liquid introduction port 542*a* and the liquid introduction port 542*b* there is provided a girder having substantially the same thickness as the thin wall portion 182. A first center line CL1 that divides a line segment connecting two ends of a row of individual communication paths 19 into equal two parts and that extends along a direction intersecting the side-by-side direction is at a location different from the location of a second center line CL2 that divides a space interval between the liquid introduction ports 542*a* and 542*b* into two equal parts and that extends along a direction intersecting the side-by-side direction. That is, the liquid introduction port 542*a* and the liquid introduction port 542*b* are different in the opening size in the side-by-side direction. In this exemplary embodiment, the liquid introduction port 542*a* is located on one of two sides in the side-by-side direction (the negative X side) and has a larger opening than the liquid introduction port 542*b*. A thick wall portion 181 includes a first inclined portion 590 that is formed by a first side portion 590*a* and a second side portion 590*b* and that is protruded in a triangular shape toward a location between the liquid introduction ports 542*a* and 542*b* in the side-by-side direction. A vertex formed by the first side portion 590*a* and the second side portion 590*b* substantially coincides with the location of the second center line CL2.

The first inclined portion 590 is asymmetric with respect to the second center line CL2. Specifically, an acute angle formed by the first side portion 590*a* of the first inclined portion 590 and the second center line CL2 is larger than an acute angle formed by the second side portion 590*b* and the second center line CL2 and the length of the first side portion 590*a* is longer than the length of the second side portion 590*b*. Due to the construction in which the location of the first center line CL1 and the location of the second center line CL2 are different from each other and the first inclined portion 590 is asymmetric with respect to the second center line CL2, even when ink is introduced from the liquid introduction ports 542*a* and 542*b* in different amounts and at different flow speeds, the ink flowing through a flow path 18 from the liquid introduction ports 542*a* and 542*b* to the individual communication paths 19 can be rectified so that the gas bubbles contained in the ink can be suitably moved to the two ends of the row of the individual communication paths 19 in the side-by-side direction.

As described above, the liquid ejecting head 500 according to this exemplary embodiment achieve the following advantageous effects.

Since the flow path formation substrate 515 of the liquid ejecting head 500 includes the first inclined portion 590 asymmetric with respect to the second center line CL2, the gas bubbles contained in ink can be suitably moved to the two ends of the row of the individual communication paths 19 even when ink is introduced from the liquid introduction ports 542*a* and 542*b* in different amounts of flow and at different flow speeds. This prevents gas bubbles from residing on the boundary portion 183, so that the amounts of ink supplied from the droplet-discharging individual communication paths 19A into the droplet-discharging pressure chambers 12A are stable.

Exemplary Embodiment 4

Figure 10:
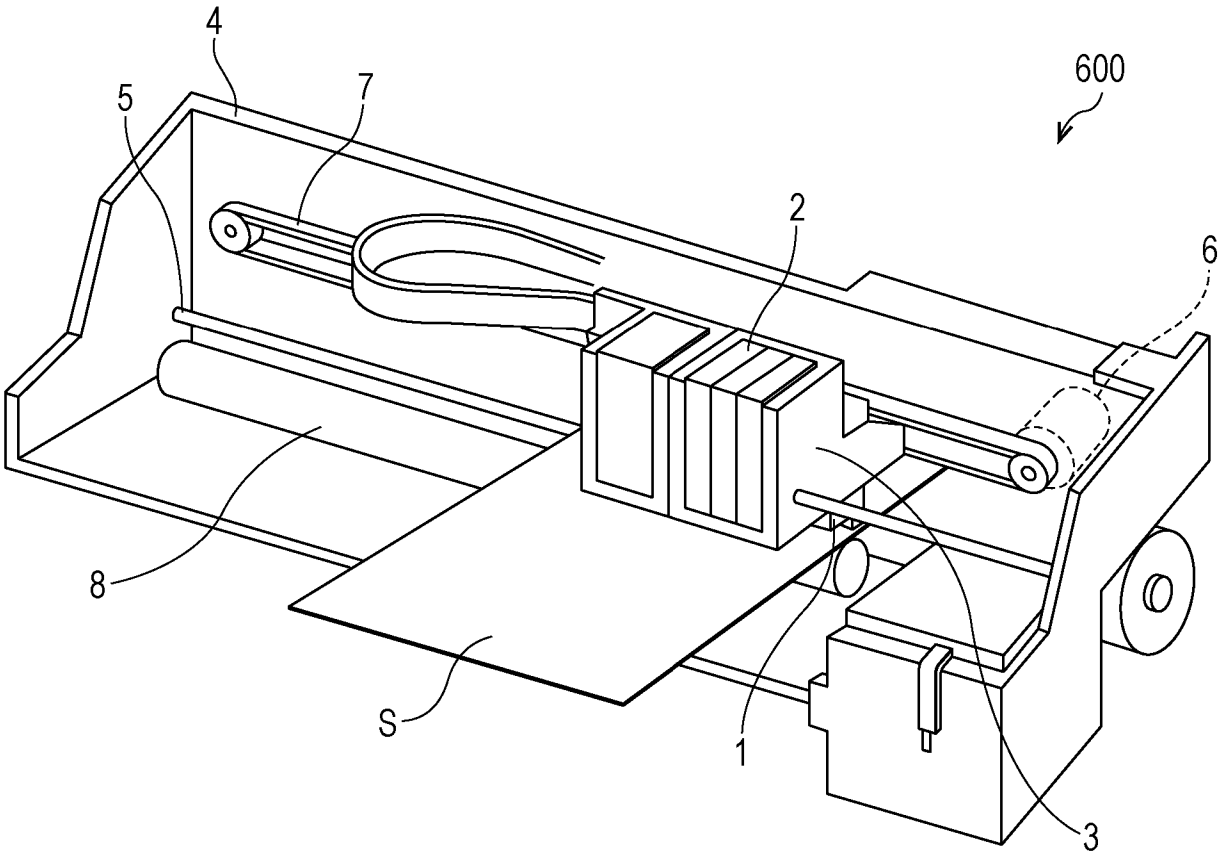
FIG. 10 is a perspective view illustrating a general construction of a liquid ejecting apparatus according to Exemplary Embodiment 4.

FIG. 10 is a perspective view illustrating a general construction of a liquid ejecting apparatus according to Exemplary Embodiment 4. A construction of a liquid ejecting apparatus 600 according to this exemplary embodiment will be described with reference to FIG. 10. Note that the same component portions and the like as in Exemplary Embodiment 1 are referenced by the same reference characters and are not redundantly described.

As illustrated in FIG. 10, the liquid ejecting apparatus 600 includes a liquid ejecting head 1. The liquid ejecting head 1 is mounted on a carriage 3 that is freely movable back and forth along an axis direction of a carriage shaft 5 (hereinafter, referred to as "main scanning direction") that is fitted to an apparatus main body 4. The liquid ejecting head 1 is supplied with ink from an ink cartridge 2 that is an ink supply unit detachably mounted on the carriage 3.

The liquid ejecting apparatus 600 includes a driving motor 6 as a power source for moving the carriage 3, plurality of gears (not depicted) that transmit drive force from the driving motor 6 to the carriage 3, a timing belt 7, etc. The liquid ejecting head 1 is moved together with the carriage 3 along the axis direction of the carriage shaft 5 by a control unit (not depicted) controlling the driving of the driving motor 6.

The liquid ejecting apparatus 600 further includes a transport roller 8 provided as a transporter unit that transports a sheet S as an example of a recording medium, a transport motor (not depicted) provided as a drive source for rotating the transport roller 8, etc. The sheet S is transported in a direction that intersects the axis direction of the carriage shaft 5 (hereinafter, referred to as the subsidiary scanning direction) as the control unit (not depicted) the driving of the transport motor. Incidentally, a transport device that transports the sheet S is not limited to the transport roller but may also be a belt, a drum, etc.

As the control unit alternately repeat the subsidiary scanning operation of transporting the sheet S in the subsidiary scanning direction and the main scanning operation of moving the liquid ejecting head 1 in the main scanning direction while causing ink to be ejected from the nozzle holes 21 (see FIG. 4), images, characters, etc. are printed on the sheet S.

Although in this exemplary embodiment, the liquid ejecting apparatus 600 has as an example a construction in which the ink cartridge 2, an ink supply unit, is mounted on the carriage 3, the liquid ejecting apparatus according to the invention is not limited to this construction. For example, the liquid ejecting apparatus may have a construction in which a liquid supply unit, such as an ink tank, is fixed to an apparatus main body 4 and ink is supplied from the liquid supply unit to a liquid ejecting head 1 through an ink tube or the like. Furthermore, a liquid supply unit may be provided separately from a liquid ejecting apparatus.

Further, although in this exemplary embodiment, the liquid ejecting head 1 is, as an example, of a serial head type that is mounted on the carriage 3 that moves back and forth and that discharges ink while being moved in the main scanning direction, the liquid ejecting head 1 according to the invention is also applicable to a line head-type liquid ejecting head that is fixed and extends in the width direction of a sheet S.

Further, although the liquid ejecting apparatus 600 of this exemplary embodiment includes the foregoing transport unit, such a transport mechanism does not limit the liquid ejecting apparatus of the invention. For example, the liquid ejecting apparatus may have a construction in which a sheet S is supported on a movable support tray or the like when the sheet S is transported. Still further, the liquid ejecting apparatus may be a so-called flat head type liquid ejecting apparatus that performs recording by moving a liquid ejecting head 1 relative to a sheet S (medium) that is fixed to a support.

As described above, the liquid ejecting apparatus 600 of this exemplary embodiment can achieve the following advantageous effects.

The liquid ejecting apparatus 600 includes the liquid ejecting head 1 designed to inhibit the residing of gas bubbles so that the amounts of ink supplied to the pressure chambers 12 (see FIG. 4) are stable. Therefore, the liquid ejecting apparatus 600 can achieve improved ink discharging performance.

What is claimed is:

1. A liquid ejecting head comprising:

a pressure chamber formation substrate provided with pressure chambers that are disposed side by side and that communicate with nozzles that discharge a liquid;

a nozzle plate provided with the nozzles; and a flow path formation substrate provided between the pressure chamber formation substrate and the nozzle plate, wherein the flow path formation substrate has a plurality of individual communication paths that supply the liquid to the pressure chambers disposed side by side, a common liquid chamber that communicates with the pressure chambers, a liquid introduction port that introduces the liquid into the common liquid chamber, and a flow path of the liquid from the liquid introduction port toward the individual communication paths, and wherein the flow path formation substrate has a thick wall portion and a thin wall portion that are located at a pressure chamber formation substrate side of the common liquid chamber and that have a relatively large substrate thickness and a relatively small substrate thickness, respectively, and wherein the thick wall portion causes area of a cross-section of the flow path taken along a thickness direction of the flow path formation substrate to be smaller at an individual communication path side than at a liquid introduction port side, and wherein the thick wall portion includes a first inclined portion that, in a plan view from the nozzle plate side, is inclined from the liquid introduction port side toward at least one end side of two end sides of the plurality of individual communication paths in a side-by-side direction in which the pressure chambers are provided side by side and along which the individual communication paths are provided, wherein the first inclined portion includes a first side portion and a second side portion, the first and second side portions protruding towards the liquid introduction port side to form a triangular shape, the triangular shape having a base wider than a distance of two communication paths.

2. The liquid ejecting head according to claim 1, wherein at least one individual communication path located at the at least one end side is formed in the thin wall portion and the individual communication paths other than the at least one individual communication path located at the at least one end side are formed in the thick wall portion.

3. A liquid ejecting apparatus comprising the liquid ejecting head according to claim 2.

4. The liquid ejecting head according to claim 1, further comprising:

a plurality of the liquid introduction port; and a second inclined portion that, in a plan view from the nozzle plate side, is protruded from between the plurality of liquid introduction ports toward the first inclined portion.

5. The liquid ejecting head according to claim 4, wherein a length of the first inclined portion along the side-by-side direction is greater than a length of the second inclined portion along the side-by-side direction.

6. A liquid ejecting apparatus comprising the liquid ejecting head according to claim 5.

7. A liquid ejecting apparatus comprising the liquid ejecting head according to claim 4.

8. The liquid ejecting head according to claim 1, further comprising a plurality of the liquid introduction port, wherein a first center line that is along a direction intersecting the side-by-side direction and that divides a line segment connecting the individual communication paths at two ends in the side-by-side direction into two equal parts and a second center line that is along a direction intersecting the side-by-side direction and that divides a space interval between the liquid introduction ports into two equal parts are at different locations, and wherein the first inclined portion is asymmetric with respect to the second center line.

9. A liquid ejecting apparatus comprising the liquid ejecting head according to claim 8.

10. A liquid ejecting apparatus comprising the liquid ejecting head according to claim 1.

* * * * *